US006609298B2

(12) United States Patent
Saitoh

(10) Patent No.: US 6,609,298 B2
(45) Date of Patent: Aug. 26, 2003

(54) PRESSURE CONTACT BLADES ADAPTABLE TO EXTRAFINE STRANDS

(75) Inventor: Yasushi Saitoh, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/150,078

(22) Filed: May 20, 2002

(65) Prior Publication Data

US 2002/0132512 A1 Sep. 19, 2002

Related U.S. Application Data

(62) Division of application No. 09/987,682, filed on Nov. 15, 2001.

(51) Int. Cl.[7] ..... H01R 43/16

(52) U.S. Cl. ..... 29/874; 29/857; 29/863; 29/865; 29/866

(58) Field of Search ..... 29/874, 857, 863, 29/865, 866, 867; 439/391

(56) References Cited

U.S. PATENT DOCUMENTS 4,018,177 A * 4/1977 McKee et al.
4,027,521 A * 6/1977 McKee et al.
4,040,702 A 8/1977 McKee et al.
4,050,760 A * 9/1977 Cohen
4,373,769 A * 2/1983 Mathe et al.
4,385,794 A * 5/1983 Lucius
4,427,251 A 1/1984 Mathe et al.
4,940,425 A 7/1990 Hass et al.
6,012,942 A * 1/2000 Volstorf

FOREIGN PATENT DOCUMENTS

JP 10-334963 A 12/1998

* cited by examiner

*Primary Examiner*—Carl J. Arbes
(74) *Attorney, Agent, or Firm*—Oliff & Berridge, PLC

(57) ABSTRACT

In an extrafine-strand-adaptable contact pressure blade, parts of the mutually opposed right and left side wall portions of a pressure contact part having a substantially U-shaped vertical section are formed by blanking so as to project inwardly in part in a substantially V-like shape, and the whole contact area of the right and left pressure contact blades with respect to the core of a wire is set at a value (equal to or larger than 0.15 $mm^2$) which allows a slot width settable range to be determined by a pressure contact test to be larger than a tolerance range caused by a manufacturing tolerance.

2 Claims, 6 Drawing Sheets

PRESSURE CONTACT BLADES ADAPTABLE TO EXTRAFINE STRANDS

This is a Division of application Ser. No. 09/987,682 filed Nov. 15, 2001. The entire disclosure of the prior application is hereby incorporated by reference herein in its entirety.

BACKGROUND OF THE INVENTION

1. Field of Invention

The present invention relates to extrafine-strand-adaptable pressure contact blades which can be contacted by a wire including a core composed of extrafine strands.

2. Description of Related Art

The upper and lower limits of the settable range C (see FIG. 8) of the slot width of a slot to be formed by pressure contact blades are determined according to the following conditions. Here, FIG. 8 is a graphical representation of the relationship of the slot width with respect to the contact resistance and contact load between the pressure contact blades and the core of a wire. In FIG. 8, a graph A shows the relationship between the slot width and contact loads, whereas a graph B shows the relationship between the slot width and contact resistance. By the way, the relationships shown by the graphs A and B are based on test results obtained by conducting a pressure contact test repeatedly in which a wire is pressure contacted with the slot of the pressure contact blades, contact resistance and contact load between the core and pressure contact blades are measured, and the strands of a wire to be tested is checked for cutting.

The graph B shows that the contact resistance can provide a stable value in the vicinity of the minimum value when the slot width is within a given area. The upper limit of the settable range C of the slot width can be given in the following manner: in case where the slot width increases and thus the contact load decreases, at a certain value of the slot width, the contact resistance is thereby allowed to rise from a value in the vicinity of the minimum value thereof; that is, the upper limit can be given by such certain value of the slot width. Also, the lower limit of the settable range C of the slot width can be given in the following manner: in case where the slot width decreases down to such a value where one or more of the strands of the core is (or are) cut (cutting of strand), the contact load is thereby decreased, which in turn allows the contact resistance to rise from a value in the vicinity of the minimum value thereof; that is, the lower limit can be given by such value of the slot width.

Next, with reference to FIG. 9, description will be given below of how the settable range C varies when the section size of a core (core size) of a wire to be pressure contacted with the pressure contact blades is varied. By the way, three sets of graphs A1–A3, B1–B3 and settable ranges C1–C3 shown in FIG. 9 correspond to the above-mentioned graphs A, B and settable range C shown in FIG. 8 when the core size is varied in three stages. In the three sets of graphs A1–A3, B1–B3 and settable ranges C1–C3, the core size of the core increases sequentially in order from the left set to the right set.

Also, referring to the upper limit of the settable range C, in case where the core size decreases, the area (contact area) of the core where the core receives the contact load from the pressure contact blades also decreases and thus the contact load to be received by the core decreases, with the result that the upper limit of the settable range C is reduced accordingly. Also, in the case of the lower limit of the settable range C, in case where the core size decreases, the section size of strands (strand size) forming the core decreases accordingly, with the result that the cutting of the strands is easy to occur and the contact load is kept from increasing: that is, the lower limit of the settable range C increases as the core size decreases.

Therefore, as can also be seen from the results of a pressure contact test shown in FIG. 9, as the core size decreases, the settable range C of the slot width decreases.

On the other hand, even in case where a pressure contact terminal is manufactured in such a manner that the slot width provides a given set value Wa (see FIG. 10) present within the settable range C, due to the manufacturing tolerance D, the slot width of an actual product provides any one of values within a tolerance range E deviated by ±D from the set value Wa.

Therefore, in case where the settable range C is too narrow, as shown in FIG. 10, the tolerance range E becomes larger than the settable range C and thus there is a fear that, when products are actually manufactured, some of them can have the slot width out of the settable range C.

Now, FIG. 11 is a perspective view of a pressure contact blade of an ordinary pressure contact terminal according to the related art. Right and left pressure contact blades 5 shown in FIG. 11 are formed integral with the pressure contact terminal in such a manner that they are formed by a pulling/raising operation so as to project inwardly from the right and left side walls 9 of the pressure contact terminal; and, the mutually opposed, vertically extending inner side end faces 5*a* of the two pressure contact blades 5 cooperate together in defining a slot 3.

However, when the thus structured conventional pressure contact blades 5 are applied to the pressure contact of a core composed of a bundle of seven or more strands and having a section size of 0.20 $mm^2$ according to the invention (such core is composed of extrafine strands), there are found the following problems.

That is, in the conventional pressure contact blade 5, for example, in the case of the pressure contact blade 5 having a plate thickness T (see FIG. 11) of 0.25 mm, when the pressure contact blade 5 is applied to the pressure contact of a wire including a core having a section size of 0.13 $mm^2$, the settable range C of the slot width obtained by a pressure contact test similar to the previously-described graphs A, B shown in FIG. 8 is given as 0.05 mm. On the other hand, in this application, a manufacturing tolerance D is 0.03 and a tolerance range E is 0.06 mm; that is, the tolerance range E is larger than the settable range C, which provides a poor yield rate and makes it substantially difficult to manufacture the pressure contact blade.

SUMMARY OF THE INVENTION

The present invention aims at eliminating the drawbacks found in the above-mentioned conventional pressure contact blade. Accordingly, it is an object of the invention to provide extrafine-strand-adaptable pressure contact blades which can set a slot width settable range to be determined by a pressure contact test larger than a tolerance range given by a manufacturing tolerance and can be manufactured easily.

In attaining the above object, according to the invention, there are provided extrafine-strand-adaptable pressure contact blades formed on a pressure contact terminal and including a slot to be pressure contactable by a wire including a core composed of a bundle of seven or more strands and having a core section size of 0.20 $mm^2$, wherein the pressure contact blades are formed by blanking parts of the two mutually opposed right and left side wall portions of the pressure contact terminal so as to project inwardly in part; and also wherein, based on test results obtained by repetitively conducting a pressure contact test in which the wire including the core is pressure contacted with the slot, the contact resistance and contact load between the core and contact pressure blades are measured and the strands of the wire are checked for cutting while varying the slot width of the slot, of the varying ranges of the slot width and contact load, a range where the contact resistance is stable and the strand cutting of the wire cannot occur is defined as a slot width settable range and the range of a tolerance with respect to the slot width caused in the manufacture of the pressure contact terminal is defined as a tolerance range, and the whole contact area of the right and left side surfaces of the slot, which hold the core of the wire between them, with respect to the core is set in such a manner that the slot width settable range is larger than the tolerance range.

Preferably, the contact area may be set equal to or larger than 0.15 $mm^2$.

DETAILED DESCRIPTION OF PREFERRED EMBODIMENTS

Now, a description will be given in more detail of preferred embodiments of the invention with reference to the accompanying drawings.

Figure 1:
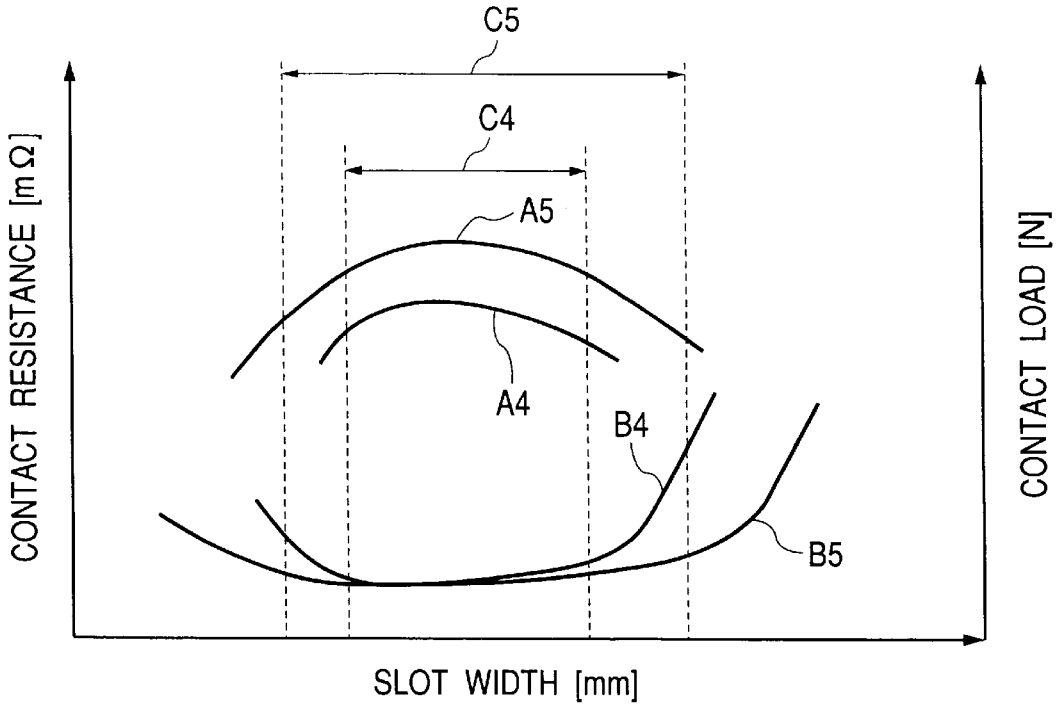
FIG. 1 is a graphical representation of the varying states of the settable range of a slot width when the whole contact area of pressure contact blades with respect to the core of a wire is varied in two stages.
Figure 8:
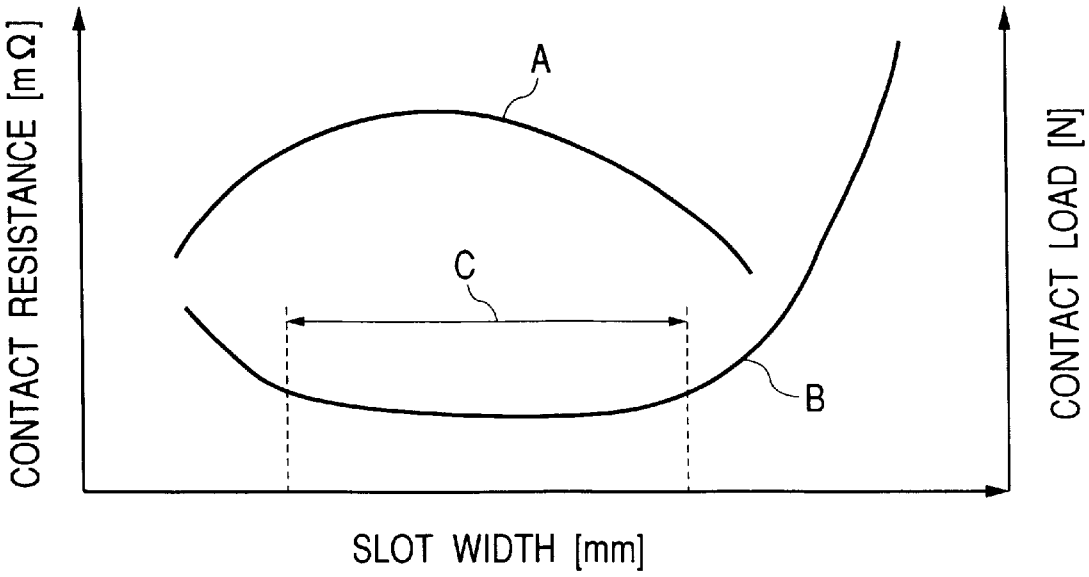
FIG. 8 is a graphical representation of the relationship of the slot width with respect to the contact resistance and contact load between the pressure contact blades and the core of a wire.
Figure 9:
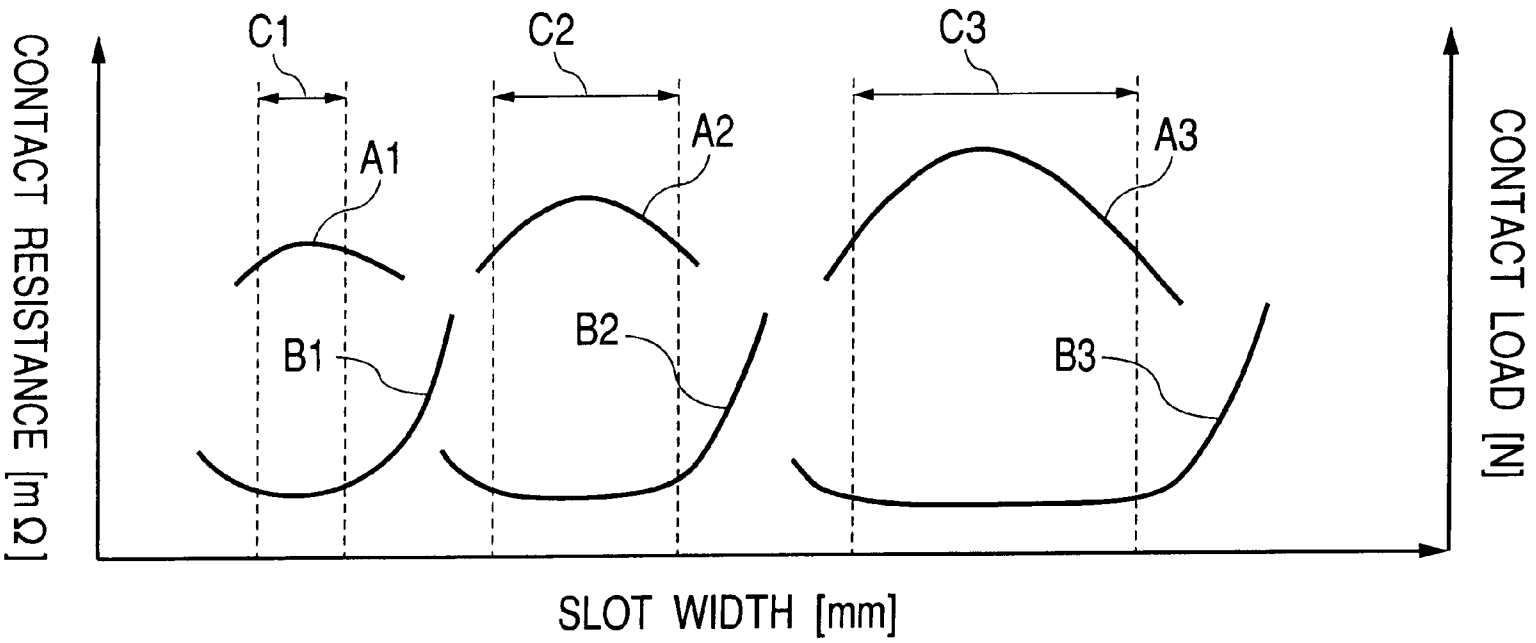
FIG. 9 is a graphical representation of the varying states of the settable range of a slot width when the core size of a wire is varied.

FIG. 1 is a graphical representation of the varying states of the settable range of a slot width when the whole contact area of contact pressure blades with respect to a core of a wire is varied in two stages. Two sets of graphs A4, A5, B4, B5 and settable ranges C4, C5 shown in FIG. 1 correspond to the previously-described graphs A, B and settable range C shown in FIG. 8 when the whole contact area of the contact pressure blades with respect to a core of a wire is varied in two stages. By the way, in the set comprising the graphs A4, B4 and settable range C4, the whole contact area of the contact pressure blades with respect to the core is set smaller in the set comprising the graphs A5, B5 and settable range C5. This shows that the settable range C increases as the whole contact area of the contact pressure blades with respect to the core increases.

Figure 10:
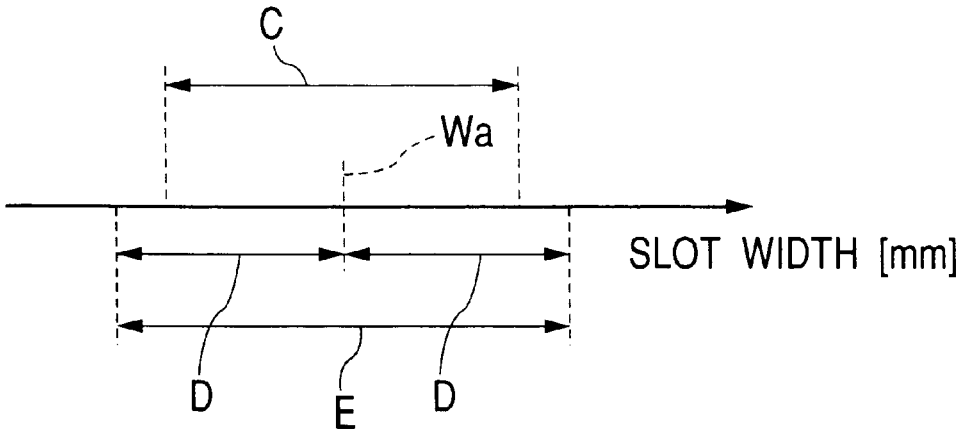
FIG. 10 is a view of the relationship between the slot width settable range and manufacturing tolerance.

Accordingly, the present inventors have paid attention to the whole contact area of the contact pressure blades with respect to the core in the settable range C and have found that, by increasing the whole contact area of the contact pressure blades with respect to the core, the settable range C of the slot width shown in the above-mentioned FIG. 10 can be made larger than the tolerance range E. And, in the case of a wire including a core having a section size of 0.20 $mm^2$, the present inventors have conducted repeatedly a similar pressure contact test to that shown in FIG. 1 while varying the contact area, and have found that, in order to make the settable range C larger than the tolerance range E, the whole contact area must be equal to or larger than 0.15 $mm^2$.

Figure 11:
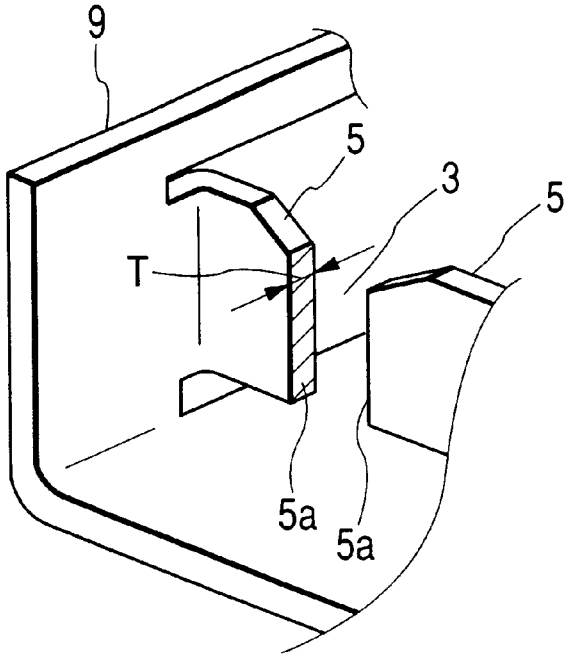
FIG. 11 is a perspective view of pressure contact blades formed in an ordinary pressure contact terminal according to the prior art.

By the way, in the conventional pressure contact blade 5 shown in the previously described FIG. 11, to increase its contact area with the core, the plate thickness T of the pressure contact blade 5 must be increased. However, the increased plate thickness T results in the increased plate thickness of the whole of the pressure contact terminal, which causes an obstacle to the formation of a spring piece in the male and female fitting portion of the pressure contact terminal. Therefore, in the case of the conventional pressure contact blade 5, it is difficult to increase its contact area with respect to the core.

In view of the above, the inventors have developed pressure contact blades by blanking; that is, the inventors have realized extrafine-strand-adaptable pressure contact blades which, without increasing the plate thickness of a pressure contact terminal, can increase their whole contact area with respect to a core of a wire.

Figure 2:
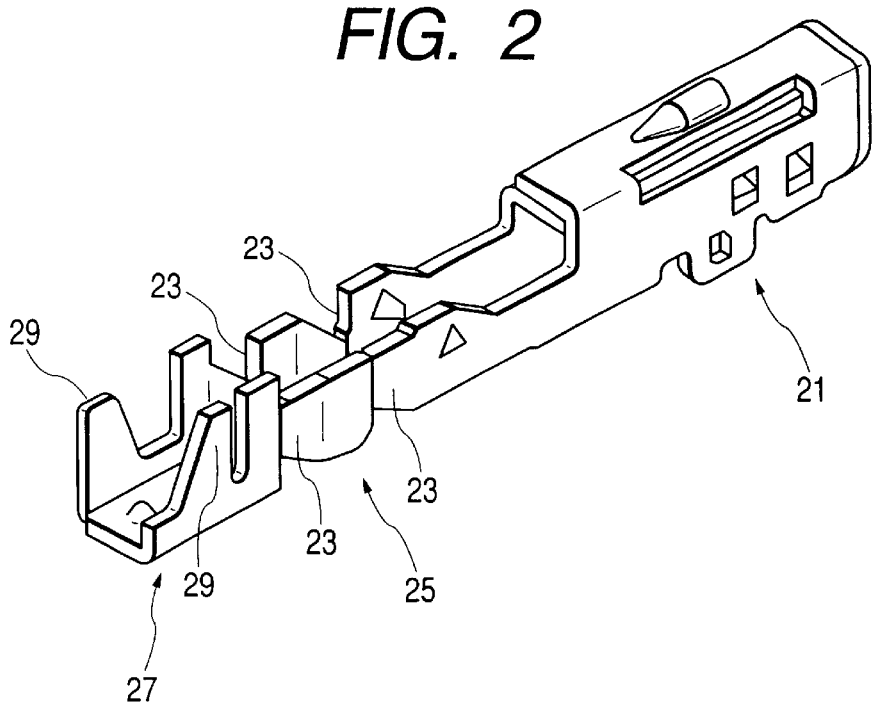
FIG. 2 is a perspective view of a pressure contact terminal to which extrafine-strand-adaptable pressure contact blades according to an embodiment of the invention are applied.
Figure 3:
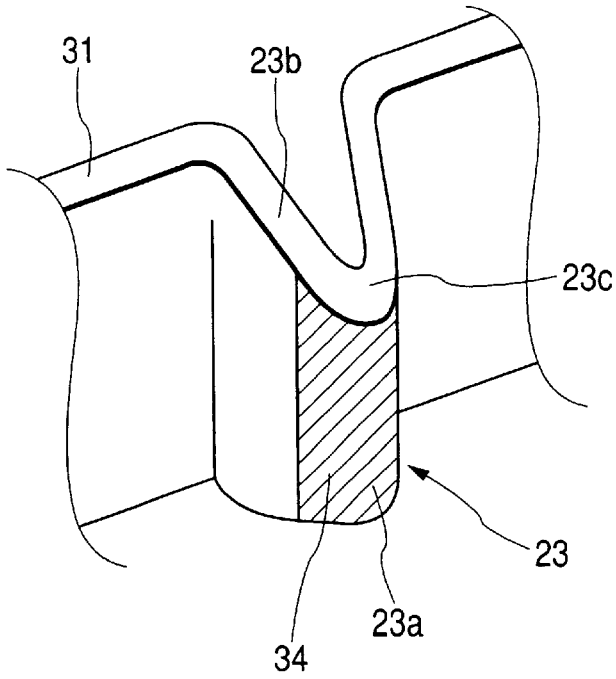
FIG. 3 is an enlarged perspective view of one of the pressure contact blades formed in the pressure contact terminal shown in FIG. 2.
Figure 4:
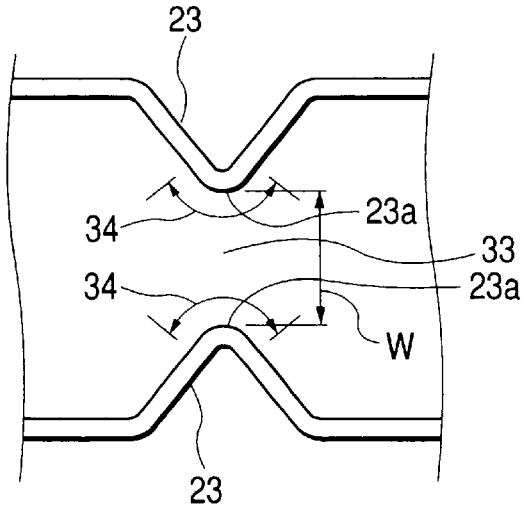
FIG. 4 is a plan view of the portion of the pressure contact terminal shown in FIG. 2 in which the pressure contact blades are formed.

Now, FIG. 2 is a perspective view of a pressure contact terminal to which there are applied extrafine-strand-adaptable pressure contact blades according to a first embodiment of the invention, FIG. 3 is an enlarged perspective view of a pressure contact blade to be formed in the pressure contact terminal shown in FIG. 2, and FIG. 4 is a plan view of a portion of the pressure contact terminal shown in FIG. 2 where the pressure contact blades are formed.

The pressure contact terminal, as shown in FIG. 2, comprises a connecting part 21 to be contactable with another connecting member (such as connecting terminal), a pressure contact part 25 in which two sets of paired right and left pressure contact blades 23 are formed, and a hold part 27 for holding a wire (not shown) which is pressure contacted with the present pressure contact terminal; and, the pressure contact terminal is formed by blanking and bending a sheet of metal plate. And, the pressure contact terminal is composed of seven or more strands (extrafine strands) bundled together (or twisted together) and is adapted such that a wire including a core having a section size of 0.20 $mm^2$ or less can be pressure contacted with the pressure contact terminal.

The connecting part 21 is disposed on the leading end side of the pressure contact terminal, the hold part 21 is disposed on the trailing end side of the pressure contact terminal, and the pressure contact portion 25 is interposed between the connecting part 21 and hold part 27. Within the connecting part 21, there is disposed a connecting tongue piece and, on the hold part 27, there are disposed two sets of paired right and left hold pieces 29 for holding a wire which is pressure contacted with the pressure contact terminal. By the way, in the present embodiment, in the pressure contact part 25, there are disposed two sets of paired right and left pressure contact blades 23. However, alternatively, there may also be disposed a set of paired right and left contact pressure blades 23.

In the right and left pressure contact blades 23 in the respective sets, as shown in FIG. 3, parts of the mutually opposed right and left side wall portions 31 of the pressure contact part 25 having a substantially U-shaped vertical section shape are formed by blanking so as to project in part inwardly, whereby slot forming portions 23*a* are formed respectively in the inward-side leading end portions of the right and left pressure contact blades 23 in the respective sets. And, the thus-formed slot forming portions 23*a* cooperate together in forming slots 33 (see FIG. 4) into which a wire can be fitted for pressure contact. That is, the surface portions of the slot forming portions 23*a* of the respective pressure contact blades 23 respectively correspond to the right and left inner surfaces of the slots 33 by and between which the core of the wire can be held or sandwiched.

According to the present embodiment, each of the pressure contact blades 23 is formed in such a manner that its horizontal section, which is obtained when it is cut along the longitudinal direction of a wire to be pressure contacted, has a substantially-V-like shape with its leading end portion slightly rounded. Also, the upper end face 23*b* of each pressure contact blade 23 is formed so as to be inclined downward toward the inside of the pressure contact part 25, whereby, when the wire is pressure inserted into the slot 33, the wire can be guided smoothly into the slot 33 through the upper end face 23*b*. And, as the wire is pressure inserted into the slot 33, the skin of the wire is slashed with the edge portions 23*c* of the pressure contact blades 23 existing inwardly of the upper end faces 23*b* to thereby expose the core of the wire, and the exposed core is pressure contacted and connected with the right and left pressure contact blades 23 in the respective sets.

Thus, since the pressure contact blade 23 is formed by blanking, there is eliminated a possibility that, as in the previously described conventional pressure contact blade 5, the plate thickness of the pressure contact terminal can increase. This makes it possible to increase easily the areas (contact areas) of the contact regions (portions shown by hatches in FIG. 3) 34 of the slot forming portions 23*a* of the right and left pressure contact blades 23 in the respective sets that can be contacted with the core of the pressure contacted wire.

And, the whole contact area of the right and left contact regions 34 (the sum total of the contact areas) is set at such a value (here, 0.15 $mm^2$ or more) that the previously described settable range C of the slot width W is larger than the tolerance range E of the present pressure contact blade 23.

Thanks to this, while the set value in design of the slot width W is set such that, with the tolerance range E taken into account, the value of the slot width W of an actual product is within the settable range C, a pressure contact terminal can be manufactured. This makes it possible to provide a pressure contact terminal to which there can be pressure contacted a wire including a core composed of extrafine strands at a low and stable contact resistance value without the wire strands being cut.

Figure 5:
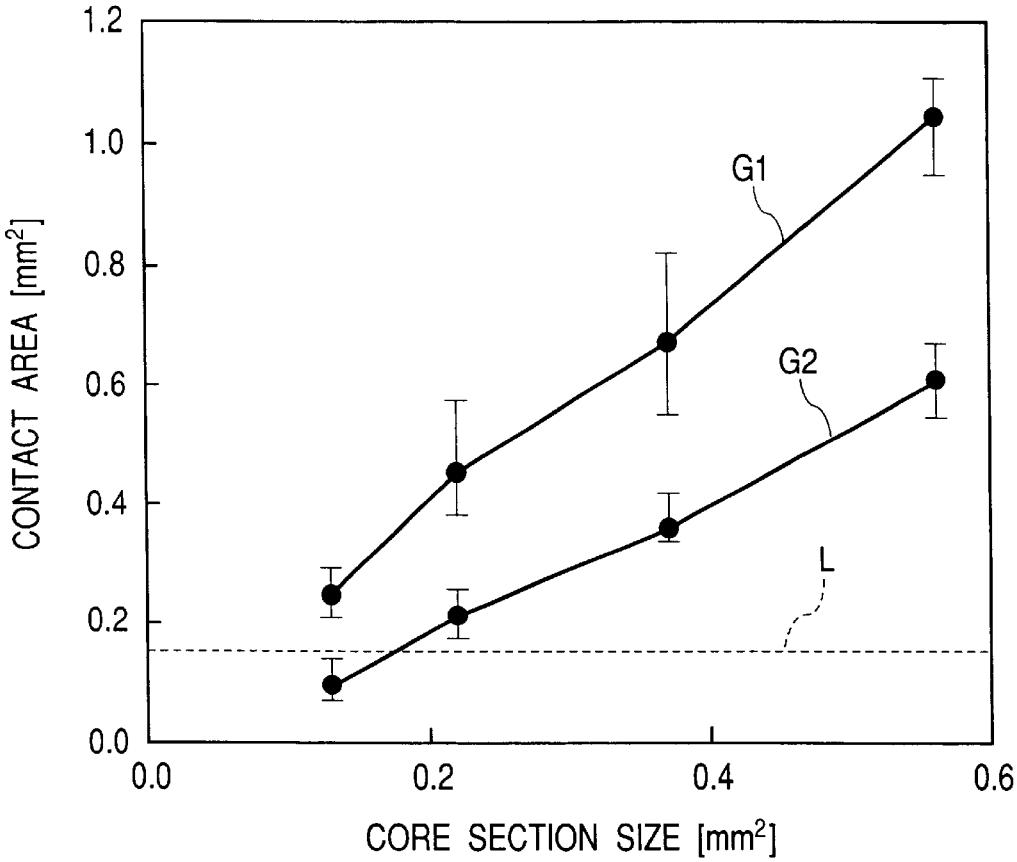
FIG. 5 is a graphical representation of the relationship between the core section size and the whole contact area of the right and left pressure contact blades according to the present embodiment.

Now, a graph G1 shown in FIG. 5 represents the relationship between the core section size and the whole contact area of the right and left pressure contact blades according to the present embodiment; and, a graph G2 in FIG. 5 represents the relationship between the core section size and the whole contact area of the right and left pressure contact blades according to the previously described prior art shown in FIG. 11. Also, an auxiliary line L in FIG. 5 shows a line where the contact area is 0.15 $mm^2$.

In the pressure contact blade 23 formed by blanking according to the present embodiment, as shown in the graph G1, even in the case of a core composed of extrafine strands and having a core section size of 0.20 $mm^2$, the whole contact area of the pressure contact blade 23 with respect to the core can be easily set at a value equal to or larger than 0.15 $mm^2$ which is necessary for the settable range C to be larger than the tolerance range E.

On the other hand, in the conventional pressure contact blade 5 shown in FIG. 11, in the case of a core composed of extrafine strands and having a core section size of 0.20 $mm^2$, the whole contact area of the pressure contact blade 5 with respect to the core is less than the value of 0.15 $mm^2$.

As has been described heretofore, according to the present embodiment, since the right and left pressure contact blades 23 are formed by blanking, the whole contact area of the pressure contact blades 23 with respect to the core of the wire can be increased relatively easily. As a result of this, the whole contact area can be set such that a slot width settable range C to be determined by a pressure contact test is greater than a tolerance range E caused due to a manufacturing tolerance, which makes it possible to provide pressure contact blades easy to manufacture and adaptable to extrafine strands.

Also, since the whole contact area of the pressure contact blades 23 is set so as to be equal to or larger than 0.15 $mm^2$, the slot width settable range C can be positively set such that it is larger than the tolerance range E.

Figure 6:
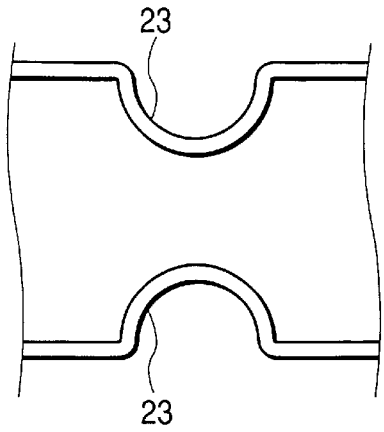
FIG. 6 is a plan view of a modification of the pressure contact blades according to the present embodiment.
Figure 7:
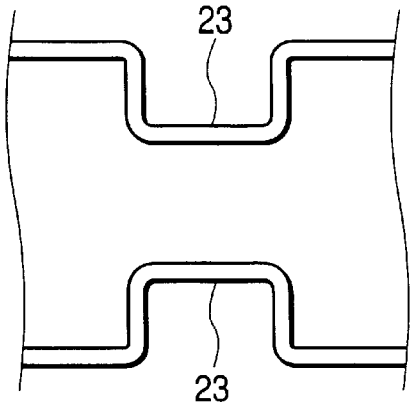
FIG. 7 is a plan view of another modification of the pressure contact blades according to the present embodiment.

By the way, in the present embodiment, the horizontal section shape of each pressure contact blade 23 is formed as a substantially V-like shape. However, this is not limitative but, for example, it may be formed as such a substantially arc-like shape as shown in FIG. 6 (here, a semicircular-like shape), or it may be formed as such a substantially trapezoid-like shape as shown in FIG. 7 (here, a rectangle-like shape).

According to the first and second aspects of the invention, since the pressure contact blades are formed by blanking parts of the two mutually opposed right and left wall portions of a pressure contact terminal so as to project in part inwardly, the whole contact area of the pressure contact blades with respect to the core of the wire can be increased relatively easily. As a result of this, the above whole contact area can be set such that a slot width settable range to be determined by a pressure contact test is greater than a tolerance range caused due to a manufacturing tolerance and thus there can be provided extrafine-strand-adaptable pressure contact blades which are easy to manufacture.

What is claimed is:

1. A method of manufacturing an extrafine-strand-adaptable pressure contact blade, wherein the blade includes a slot to be pressure contactable by a wire, the wire including a core having a bundle of seven or more strands and having a core section size of 0.20 $mm^2$, comprising:

forming blanking parts of two mutually opposed right and left side wall portions of a pressure contact terminal so as to project inwardly in part;

repetitively conducting a pressure contact test in which the wire including the core is pressure contacted with the slot, wherein said pressure contact test comprises the steps of measuring the contact resistance and contact load between the core and the contact pressure blade, and checking the strands of a wire to be tested for cutting while varying the slot width of the slot;

defining a slot width settable range as a range where the contact resistance is stable and the strand cutting of the wire cannot occur for the varying ranges of said slot width and said contact load;

defining a tolerance range as a range of tolerance with respect to the slot width caused in the manufacture of the pressure contact terminal; and setting the contact area of the right and left side surfaces of the slot, which hold the core of the wire between them, with respect to the core in such a manner that the slot width settable range is larger than the tolerance range.

2. The method of claim 1, wherein the contact area is set equal to or larger than 0.15 $mm^2$.

* * * * *